US011692256B2

(12) United States Patent
Somekawa et al.

(10) Patent No.: US 11,692,256 B2
(45) Date of Patent: Jul. 4, 2023

(54) MAGNESIUM-BASED WROUGHT ALLOY MATERIAL AND MANUFACTURING METHOD THEREFOR

(71) Applicant: National Institute for Materials Science, Ibaraki (JP)

(72) Inventors: Hidetoshi Somekawa, Ibaraki (JP); Yoshiaki Osawa, Ibaraki (JP)

(73) Assignee: NATIONAL INSTITUTE FOR MATERIALS SCIENCE, Tsukuba (JP)

( * ) Notice: Subject to any disclaimer, the term of this patent is extended or adjusted under 35 U.S.C. 154(b) by 315 days.

(21) Appl. No.: 16/629,906

(22) PCT Filed: Jul. 10, 2018

(86) PCT No.: PCT/JP2018/026096

§ 371 (c)(1),
(2) Date: Jan. 9, 2020

(87) PCT Pub. No.: WO2019/013226

PCT Pub. Date: Jan. 17, 2019

(65) Prior Publication Data

US 2021/0079508 A1 Mar. 18, 2021

(30) Foreign Application Priority Data

Jul. 10, 2017 (JP) ..... JP2017-134461

(51) Int. Cl.
*C22F 1/06* (2006.01)
*C22C 23/00* (2006.01)

(52) U.S. Cl.
CPC ..... *C22F 1/06* (2013.01); *C22C 23/00* (2013.01)

(58) Field of Classification Search
CPC ..... C22F 1/06; C22C 23/00
See application file for complete search history.

(56) References Cited

U.S. PATENT DOCUMENTS 3,063,834 A 11/1962 Olds
6,264,762 B1 * 7/2001 Bommer ..... C22C 23/00 148/420

(Continued)

FOREIGN PATENT DOCUMENTS

CN 103060649 A 4/2013
CN 104480330 A 4/2015

(Continued)

OTHER PUBLICATIONS

Wei-Ii Cheng et al., "Corrosion behavior of Mg—6Bi—2Sn alloy in the simulated body fluid solution: The influence of microstructural characteristics", Available online: Oct. 13, 2017, Journal of Alloys and Compounds 731, 945-954. (Year: 2017).*

(Continued)

*Primary Examiner* — Brian D Walck
*Assistant Examiner* — Nazmun Nahar Shams
(74) *Attorney, Agent, or Firm* — Trojan Law Offices

(57) ABSTRACT

Adding multiple solute elements could create fracture origin through formation of intermetallic compound due to bonding of added elements. While maintaining microstructure for activating non-basal dislocation movement, additive elements not to create fracture origin, but to promote grain boundary sliding are preferably found from among inexpensive and versatile elements. Provided is Mg-based wrought alloy material including two or more among group consisting of Mn, Zr, Bi, and Sn; and Mg and unavoidable constituents, having excellent room-temperature ductility and characterized by having finer crystal grain size in Mg parent phase during room-temperature deformation and in that mean grain size in matrix thereof is 20 μm or smaller; rate of $(\sigma_{max}-\sigma_{bk})/\sigma_{max}$ (maximum load stress ($\sigma_{max}$), breaking stress ($\sigma_{bk}$)) in stress-strain curve obtained by tension-compression test of the wrought material is 0.2 or (Continued)

higher; and resistance against breakage shows 200 kJ or higher.

20 Claims, 4 Drawing Sheets

(56) References Cited

U.S. PATENT DOCUMENTS

| | | | | |
|---|---|---|---|---|
| 2008/0017285 | A1 | 1/2008 | Mukai et al. | |
| 2013/0039805 | A1* | 2/2013 | Somekawa | C22C 23/04 420/408 |
| 2015/0083285 | A1 | 3/2015 | Somekawa et al. | |
| 2016/0024629 | A1* | 1/2016 | Liang | C22F 1/06 148/420 |
| 2016/0168678 | A1 | 6/2016 | Li et al. | |
| 2019/0078186 | A1 | 3/2019 | Somekawa et al. | |

FOREIGN PATENT DOCUMENTS

| | | | |
|---|---|---|---|
| CN | 103667838 | B | 2/2016 |
| CN | 104451304 | B | 2/2017 |
| JP | 2008-214668 | A | 9/2008 |
| JP | 2016-017183 | A | 2/2016 |
| JP | 2016-089228 | A | 5/2016 |

OTHER PUBLICATIONS

Oaqing Fang et al: "Microstructure and mechanical properties of deformed Mg—Mg—Sn alloys", International Journal of Materials Research, vol. 106, No. 3, Mar. 11, 2015 (Mar. 11, 2015), pp. 307-310, XP055698627, DE ISSN: 1862-5282, DOI: 10.3139/146.111177.

First Office Action for related Chinese Patent App. No. 201880046474.6, dated Jan. 25, 2021.

Second Office Action for related Chinese Patent App. No. 201880046474.6, dated Jul. 28, 2021, issued by the China National Intellectual Property Administration.

Huo Rui, Study on microstructure and Corrosion Behavior of biomedical Mg—Bi based alloys, Master Degree Thesis of Taiyuan University of Technology, Feb. 28, 2017, pp. 32, 35-43, China Academic Journal Electronic Publishing House.

Ichikawa Riei*,On the alloying elements for Mg—Zr system alloys (2nd Report), Jul. 23, 1960, pp. 360-368.

J. Koike et al., "The activity of non-basal slip systems and dynamic recovery at room temperature in fine-grained AZ31B magnesium alloys", Acta Mater, 51 (2003) p. 2055-2065.

* cited by examiner

MAGNESIUM-BASED WROUGHT ALLOY MATERIAL AND MANUFACTURING METHOD THEREFOR

TECHNICAL FIELD

The present invention relates to a magnesium (Mg)-based alloy wrought product (material) with a fine crystal grain and excellent room-temperature ductility, to which at least two kinds of elements among four kinds of elements: manganese (Mn), zirconium (Zr), bismuth (Bi), and tin (Sn) are added, and a method for producing the same. More specifically, it relates to a magnesium (Mg)-based alloy wrought material, to which no other kinds of elements than the above four kinds of elements are added, and a method for producing the same.

BACKGROUND ART

The Mg alloy attracts a lot of attention as the lightweight metal material of the next generation. However, since the crystal structure of Mg metal is hexagonal, the difference of the critical resolved shear stress (CRSS) of basal slip and that of non-basal slip represented by prismatic slip is extremely large at around the room temperature. Therefore, compared to other metal wrought materials such as aluminum (Al) and iron (Fe), it is a difficult-to-machine material with plastic deformation at the room temperature because of its poor ductility.

In order to solve such a technical problem, alloying with addition of rare earth element is often employed. For example, in the patent reference 1 or 2, an attempt has been made to improve the plastic deformability by adding a rare earth element such as yttrium (Y), cerium (Ce), and lanthanum (La). This is because the rare earth element may have a role of lowering the CRSS of the non-basal plane, that is, reducing the difference of CRSS's of the basal plane and the non-basal plane so as to facilitate dislocation slip movement of the non-basal plane. However, because of price hikes of raw materials, a substituting material for the rare earth element is in demand from an economic point of view.

On the other hand, near crystal grain boundaries, it is pointed out that complicated stress that is necessary for continuing the deformation, that is, grain boundary compatibility stress works so as to activate the non-basal slip (non-patent reference 1). Therefore, it is proposed that introducing a large amount of crystal grain boundaries (crystal grain refinement) is effective on the improvement of ductility.

The patent reference 3 discloses a Mg alloy with refined crystal grains having an excellent strength property in which the crystal grains are refined by containing a small amount of one kind of element from among Ca, Sr, Ba, Sc, Y, La, Ce, Pr, Nd, Pm, Sm, Eu, Gd, Tb, Dy, Ho, Dr, Tm, Yb, and Lu, which are rare earth elements or versatile elements. It is said that increasing the strength of the alloy is mainly caused by segregating these solute elements at grain boundaries. On the other side, the dislocation slip movement of the non-basal plane is activated due to action of the grain boundary compatibility stress in the Mg alloy with refined crystal grains.

However, with respect to the grain boundary sliding effective in complementing the plastic deformation, the grain boundary sliding hardly contributes to the deformation since any of the added elements are effective in preventing the grain boundary sliding. Therefore, the ductility of these alloys at the room temperature is comparable to that of the conventional Mg alloy such that further improvement in the ductility is in demand. That is, it is necessary to find a solute element that would not prevent the grain boundary sliding while the fine structure (microstructure) on which the grain boundary compatibility acts is maintained.

The present inventors focused on adding only one kind of solute element thereto and disclosed that adding 0.07-2 mass % of Mn is effective in improving the room temperature ductility in the patent reference 4 and that adding 0.11-2 mass % of Zr instead of Mn is also effective in improving the room temperature ductility in the patent reference 5. In addition, it was found that adding 0.25-9 mass % of Bi instead of Mn or Zr is also effective in improving the room temperature ductility and a patent application was filed (cf. WO2017/154969). These alloys are characterized in that the average crystal grain size is not exceeding 10 micrometer and that the elongation at break is around 100% and that the m value (=strain rate sensitivity exponent) is at least 0.1. These alloys are characterized in that the degree of stress reduction, used as the formability index, is at least 0.3. However, from the industrial point of view, it is necessary to be good in the room temperature ductility and the formability in condition of higher speed, that is, in a high rate range. It is also necessary for material constituting a structural object not only to have preferable room temperature ductility and excellent formability in manufacturing a member of the structural object when the material is used for the member, but also to have a large fracture resistance (=energy absorption capacity) against the fracture so as not to break abruptly. That is to say, it is desirable to develop a Mg-based alloy having an excellent energy absorption capacity so as not to break abruptly as well as both room temperature ductility and formability.

Generally speaking, in order to improve the fracture resistance (energy absorption capacity) against break of metallic material, a plurality of kinds of solute elements are often added. However, in the case where a plurality of elements are added thereto, intermetallic compounds are formed as the added elements are mutually bonded or the added elements are bonded to the parent element (Mg in the present invention) during a melting process and a heat treatment as well as an expansion forming process. These intermetallic compounds can become a fracture origin as they may act as a stress concentration site during deformation. Therefore, although an additive element exhibits an excellent property in the binary alloy, it is unclear if this effect caused by the additive element in the binary alloy still should be exhibited in the ternary alloy or in the quaternary alloy by the addition of a plurality of elements. (Here, the binary alloy is an alloy to which one kind of element is added and the ternary alloy and the quaternary alloy are an alloy to which two kinds of elements are added and an alloy to which three kinds of elements are added, respectively.)

For example, it is known that a rare earth element such as Y is effective as an element to activate non-basal dislocation in the Mg-based binary alloy as mentioned above. However, in a Mg-4 mass % Y-3 mass % MM alloy: commonly known as WE43 alloy (MM: misch metal), it is pointed out that an intermetallic compound containing a rare earth element as a main component is formed in a Mg parent phase such that dispersion of these particles of the intermetallic compound causes ductility thereof to be lowered. Thus, it is difficult to foresee the effect of adding a plurality of kinds of elements beforehand.

PRIOR ART REFERENCES

Patent References

[Patent Reference 1] WO2013/180122
[Patent Reference 2] JP 2008-214668 A
[Patent Reference 3] JP 2006-16658 A
[Patent Reference 4] JP 2016-17183 A
[Patent Reference 5] JP 2016-89228 A
[Patent Reference 6] WO2017/154969

Non Patent Reference

[Non Patent Reference 1] J. Koike et al., Acta Mater, 51 (2003) p 2055.

SUMMARY OF INVENTION

Technical Problem to be Solved by Invention

As mentioned above, it is an object to provide a Mg-based alloy relatively in an inexpensive manner in the present application since there is a high demand for the Mg-based alloy that is easily processed by the plastic deformation and, in particular, has an excellent room temperature ductility and formability even in a high speed range and an excellent energy absorption capacity so as not break abruptly.

Means for Solving Technical Problem

Here, as far as the present inventors know, there are no references or disclosed samples in which additive elements are so effective that a Mg-based ternary alloy or a Mg-based quaternary alloy containing at least two kinds of elements of Mn, Zr, Bi, and Sn has comparable or even better mechanical property if compared to a Mg-based binary alloy containing any one of Mn, Zr, Bi, and Sn. And the present inventors believe that there are no references that disclose properties of the Mg-based ternary alloy or the Mg-based quaternary alloy containing at least two kinds of elements of Mn, Zr, Bi, and Sn.

However, after the intensive study, the present inventors found out that a Mg-based alloy wrought material could be provided which had an excellent room temperature workability and deformability and exhibited a large fracture resistance (=energy absorption capacity) against the fracture so as not to break abruptly, if compared to the conventional alloy (for example, AZ31), by hot-working and warm-working with the controlled temperature and reduction ratio of an Mg-based alloy material to which two or more kinds of elements of the four kinds: Mn, Zr, Bi, and Sn were added. Here, the wrought material is a generic term of the material worked and formed into a plate-like, tubular, rod-like, or threadlike shape through a plastic-strain applying process in a hot temperature (hot-working), a warm temperature (warm-working), or a cold temperature (cold-working) such as rolling, extruding, drawing, and forging.

Concretely, the following are provided.

In a first aspect of the present invention, provided is a Mg-based alloy wrought material comprising Mg-A mol % X-B mol % Z wherein the remainder comprises Mg and unavoidable impurities, wherein X is any one kind of element from Mn, Bi, and Sn, wherein Z is one or more kinds of elements from Mn, Bi, Sn, and Zr, but does not overlap the element of X, wherein a value of A is at least 0.03 mol %, but not exceeding 1 mol %, wherein, with respect to the relationship of A and B, A≥B and the upper limit of B is 1.0 times as large as or less than the upper limit of A and the lower limit of B is at least 0.03 mol %, and wherein an average crystal grain size of the Mg-based alloy wrought material is not exceeding 20 micrometer. Here, in general, the Mg-based alloy wrought material is manufactured by melting raw metal material, casting the melt, performing a solution treatment of the cast alloy, and applying plastic strain to the cast alloy after the solution treatment.

In the second aspect of the present invention, provided is the Mg-based alloy wrought material as described in the above first aspect, wherein intermetallic compound particles constituted of Mg and the added elements (added metal other than Mg) and having an average diameter of not exceeding 0.5 micrometer are dispersed in Mg mother phase and/or crystal grain boundaries of a metallographic structure of Mg-based alloy wrought material. Here, the intermetallic compound particles refer to particles comprising intermetallic compound comprising a compound or a mixture of parent phase elements and added elements. In general, the intermetallic compound is said to refer to a compound that is constituted of two or more kinds of metals wherein atomic ratios of constituent elements are composed of integers and exhibits specific physical and chemical properties different from those of the ingredient elements. The shapes of the particles could be in a spherical shape, a needle shape, and a plate shape depending on respective compositions.

In the third aspect of the present invention, provided is the Mg-based alloy wrought material described in the above first aspect or the above second aspect, wherein the value of the formula of $(\sigma_{max}-\sigma_{bk})/\sigma_{max}$ is 0.2 or more when the maximum applied stress is defined as $(\sigma_{max})$ and the stress at break is defined as $(\sigma_{bk})$ in a stress-strain diagram obtained by the room temperature tensile test in which an initial strain rate of the wrought material is set to $1\times10^{-3}$ $s^{-1}$ or less. In such an alloy, the value of the degree of stress reduction $(\alpha_{max}-\alpha_{bk})/\sigma_{max}$ is at least 0.2 such that the room temperature ductility is excellent as compared to that of the conventional alloy (for example, AZ31).

In the fourth aspect of the present invention, provided is the Mg-based alloy wrought material as described in any one of the above first aspect to the above third aspect, wherein the Mg-based alloy wrought material does not break even if the nominal strain of 0.2 or more is applied in the room temperature tensile test or compression test in which the initial strain rate of the wrought material is set to $1\times10^{-3}$ $s^{-1}$ or less. The test may be either tensile or compression test. Thus-described alloy does not break even if the nominal strain of 0.2 or more is applied, the room temperature ductility is excellent as compared to the conventional alloy (for example, AZ31) so as not to break abruptly.

In the fifth aspect of the present invention, provided is the Mg-based alloy wrought material as described in any one of the above first aspect to the above fourth aspect, wherein the area enclosed by the nominal stress-and-nominal strain curve in the stress-strain diagram obtained by the room temperature compression test in which the initial strain rate of the wrought material is set to $1\times10^{-3}$ $s^{-1}$ or more exhibits 200 kJ or more with respect to the Mg-based alloy wrought material. The thus-described alloy has a large fracture resistance against the fracture as compared to the conventional alloy (for example, AZ31) since the area enclosed by the nominal stress-and-nominal strain curve is at least 200 kJ.

In the sixth aspect of the present invention, provided is a method of manufacturing the Mg-based alloy wrought material as described in any one of the above first aspect to the above fifth aspect, the method comprising: performing the solution treatment of the Mg-based alloy cast material having been melted and cast at a temperature of at least 400 degree Celsius and not exceeding 650 degree Celsius for at least 0.5 hour and not exceeding 48 hours and, as a process of applying plastic strain, making the treated Mg-based alloy undergo a hot plastic working at a temperature of at least 50 degree Celsius and not exceeding 550 degree Celsius with at least 70% of cross-section reduction rate. Here, the cross-section reduction rate is a technical term used in the plastic working such as forging and may be defined by the cross-section reduction rate=(cross-section area of raw material−cross-section area of processed material)/cross-section area of raw material×100%. And, for example, a processing method of heating metal at a temperature equal to or higher than the recrystallization temperature and forming the metal into a plate shape, a bar shape, a predetermined shape (shaped steel) may be named as an example of the hot plastic working, but it is not limited thereto. In a cross-section approximately perpendicular to the direction of the expansion forming process of such a plate, a bar, and shaped steel, the ratio of the amount subtracting the cross-section area of the formed product after processing from the cross-section area of the raw material before processing to the cross-section area of the raw material before processing corresponds to the cross-section reduction rate. In such a processing method, an elongated product such as a rail may be produced continuously. And a method of manufacturing a Mg-based alloy wrought material may also be provided wherein the method comprises: the step of melting a Mg-based alloy comprising Mg-A mol % X-B mol % Z wherein the remainder comprises Mg and unavoidable impurities, wherein X is any one kind of Mn, Bi, and Sn, wherein Z is one or more kinds of Mn, Bi, Sn, and Zr, but does not overlap the element of X, wherein a value of A is at least 0.03 mol %, but not exceeding 1 mol %, wherein, with respect to the relationship of A and B, A≥B and the upper limit of B is 1.0 times as large as or less than the upper limit of A and the lower limit of B is at least 0.03 mol %; casting the melt to form a Mg-based alloy cast material; the step of making the Mg-based alloy cast material undergo the solution treatment at a temperature of at least 400 degree Celsius and not exceeding 650 degree Celsius for at least 0.5 hours and not exceeding 48 hours so as to manufacture the solution treated Mg-based alloy; and the step of applying plastic strain so as to making the solution treated Mg-based alloy undergo the hot plastic working at a temperature of at least 50 degree Celsius and not exceeding 550 degree Celsius with at least 70% of cross-section reduction rate. And, as mentioned above, Mg-based alloy wrought materials having respective properties could be manufactured if A and B as well as X and Z are defined.

In the seventh aspect of the present invention, provided is the method of manufacturing the Mg-based alloy wrought material as described in the above sixth aspect, wherein the method of applying plastic strain comprises any one of extrusion, forging, rolling, and drawing.

BRIEF EXPLANATIONS OF DRAWINGS

EMBODIMENT CARRYING OUT INVENTION

In embodiments of the present invention, a Mg-based alloy raw material comprises: Mg-A mol % X-B mol % Z wherein X is any one kind of element of Mn, Bi, and Sn and wherein Z is any one or more kinds of elements selected from a group consisting of Mn, Bi, Sn, and Zr. That is, if X is Mn, Z should be at least one kind of element from Bi, Sn, and Zr. If X is Sn, Z should be at least one kind of element from Bi, Mn, and Zr. And if X is Bi, Z should be at least one kind of element from Mn, Sn, and Zr. With respect to the relationship between A and B, A≥B and A is preferably not exceeding 1 mol %, more preferably not exceeding 0.5 mol %, yet more preferably at least 0.3 mol %. The lower limit of A is at least 0.03 mol %. The upper limit of B is preferably not exceeding 1.0 times as large as the upper limit of A, more preferably not exceeding 0.9 times, and yet more preferably not exceeding 0.8 times. The lower limit of B is at least 0.03 mol %.

Here, 0.03 mol % is a value to define a boundary between unavoidable impurities and added elements. If a recycled Mg-based alloy is used as a raw material of Mg-based alloy raw material, various kinds of alloy elements may be originally included such that the content amount usually contained therein should be excluded in the case where the Mg-based alloy raw material is used. Examples of elements contained in the unavoidable impurities may include Fe (iron), Si (silicon), Cu (copper), and Ni (nickel).

Here, in embodiments of the present invention, the Mg-based alloy raw material may be represented by Mg-aMn-bBi-cSn-dZr (a, b, c, and d represent amounts of mol %, respectively) and could be treated as a material that satisfies any one of the following conditions. Here, a, b, c, and d are at least 0, respectively. (1) Condition 1 (a corresponds to A. b+c+d corresponds to B.)

$$1 \geq a \geq b+c+d \geq 0.03;$$

(2) Condition 2 (b corresponds to A. a+c+d corresponds to B.)

$$1 \geq b \geq a+c+d \geq 0.03; \text{ and}$$

(3) Condition 3 (c corresponds to A. a+b+d corresponds to B.)

$$1 \geq c \geq a+b+d \geq 0.03.$$

Figure 7:
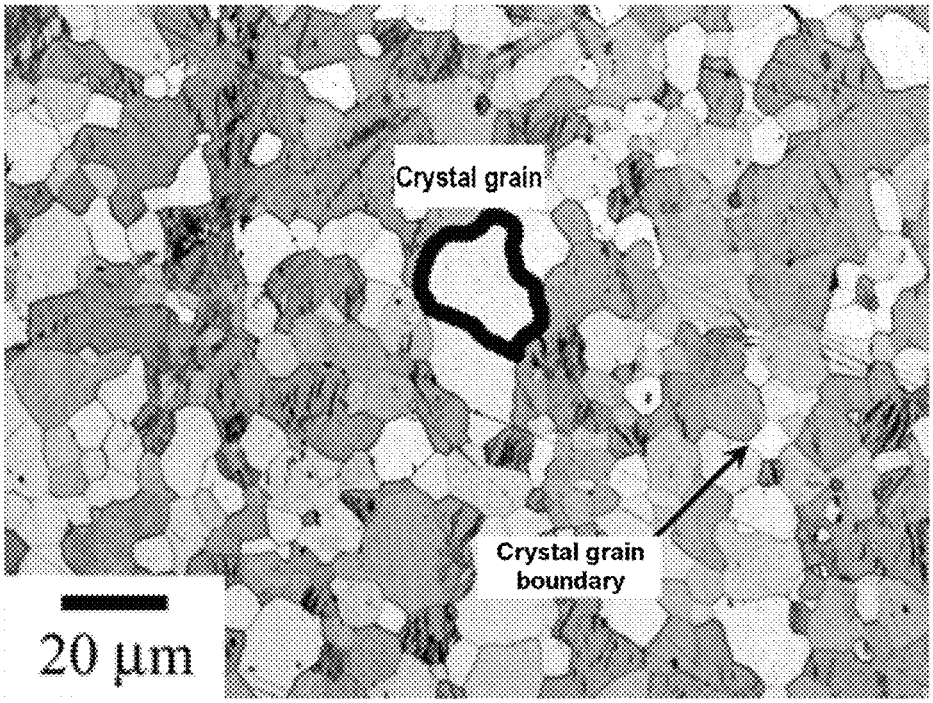
FIG. 7 shows a microstructure diagram obtained by the optical microscope observation of the Mg-3Al-1Zn alloy extruded material.

The average crystal grain size of the Mg parent phase, that is, crystal grains after hot-working is preferably not exceeding 20 micrometer. More preferably it is not exceeding 10 micrometer and further preferably it is not exceeding 5 micrometer. The measurement of the crystal grain size is preferably conducted by an intersection method (G 0551: 2013) based on the JIS standard through the optical microscope observation of the intersection (A conceptual diagram in which crystal grains and grain boundaries appear in the microscopic field of view is shown in FIG. 7.). In the case where the crystal grain size is so fine or crystal grain boundaries are not so clear, it is not easy to employ the intersection method such that the measurement may be conducted by the bright-field image and the dark-field image obtained by the transmission electron microscope observation or the electron backscatter diffraction image. Here, in the case where the crystal grain size is larger than 20 micrometer, the grain boundary compatibility stress arising near the crystal grain boundaries does not affect all region of grain interior. That is to say, it is difficult for the non-basal dislocation slip to make an occurrence in all region of grain interior such that it cannot be expected that the ductility would be improved. If the average crystal grain size is not exceeding 20 micrometer, of course, the intermetallic compounds having the size of 0.5 micrometer or less could be dispersed inside the Mg crystal grains and the crystal grain boundaries. And if the average crystal grain size is maintained not exceeding 20 micrometer, it is OK to conduct a heat treatment such as a strain annihilation via annealing after the hot working. Here, it is OK either the added elements may be segregated or may not be segregated at the crystal grain boundaries.

Next, a method of manufacturing in order to obtain a fine structure will be explained. The solution treatment is performed with respect to the melt Mg-based alloy cast material at a temperature of at least 400 degree Celsius and not exceeding 650 degree Celsius. Here, in the case where the temperature of the solution treatment is less than 400 degree Celsius, it is not preferable from the industrial point of view since it is necessary to hold the temperature for a long period of time in order to have the added solute elements homogeneously solid solved. On the other hand, if the temperature exceeds 650 degree Celsius, it may not be safe for operation since the localized melting begins because it is at a solid phase temperature or higher. And the period of time for the solution treatment is at least 0.5 hours and not exceeding 48 hours. If it is less than 0.5 hours, it is insufficient for the solute elements to be dispersed in all region inside the parent phase such that segregation during the casting remains and a good raw material cannot be manufactured. If it is longer than 48 hours, the operation time becomes longer so as not to be preferable from the industrial point of view. With respect to the casting method, any method such as gravity casting, sand casting, die casting, continuous casting, etc. that can manufacture the Mg-based alloy cast material of the present invention of course may be employed.

After the solution treatment, a hot strain application process is conducted. The temperature during the hot working is preferably at least 50 degree Celsius and not exceeding 550 degree Celsius; more preferably at least 75 degree Celsius and not exceeding 525 degree Celsius; and further preferably at least 100 degree Celsius and not exceeding 500 degree Celsius. If the working temperature is less than 50 degree Celsius, so many deformation twins that may be an origin of break or crack are caused such that a good wrought material could not be manufactured. If the working temperature is higher than 550 degree Celsius, the recrystallization may proceed during the working process such that refinement of the crystal grains would be prevented and further cause the lifetime of the mold for the working to be shortened.

The application of strain during the hot working is characterized by the total cross-section reduction rate of at least 70%, preferably at least 80%, and more preferably at least 90%. If the total cross-section reduction rate is less than 70%, the strain application is not enough such that the crystal grain size cannot be refined. It is also considered that the structure with a mixture of fine grains and coarse grains may be formed. In such a case, the room temperature ductility is lowered because the coarse grain may become a fracture origin. With respect to the hot working process, typically extrusion, forging, rolling, drawing and so on may be representative, but any processing method that is a plastic working method that can apply strain could be employed. However, it cannot be said that it is preferable only to perform the solution treatment for the cast material without conducting the hot working since the crystal grain size in the Mg parent phase tends to be coarse.

Now, the indices to evaluate the ductility and formability of the Mg-based alloy wrought material at the room temperature, that is, the degree of stress reduction and the resistance (hereinafter defined as F) against the fracture are explained. Both indices could be calculated from the nominal stress-and-nominal strain curve obtained by the room temperature tensile test and compression test, respectively. Here, since the speeding-up in the rate is important, it is assumed that the nominal stress-and-nominal strain curve is obtained with the initial strain rate of $1\times10^{-3}$ $s^{-1}$ or higher in both tensile and compression tests.

Figure 1:
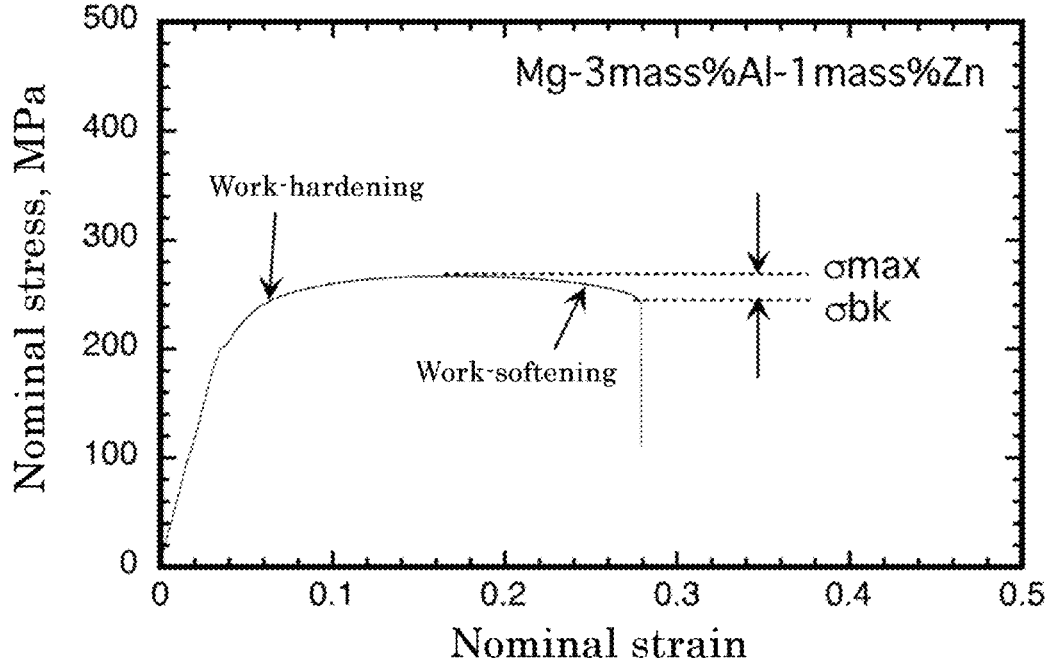
FIG. 1 shows a nominal stress-nominal strain curve obtained by a room temperature tensile test of a Mg-3Al-1Zn alloy extruded material.
Figure 2:
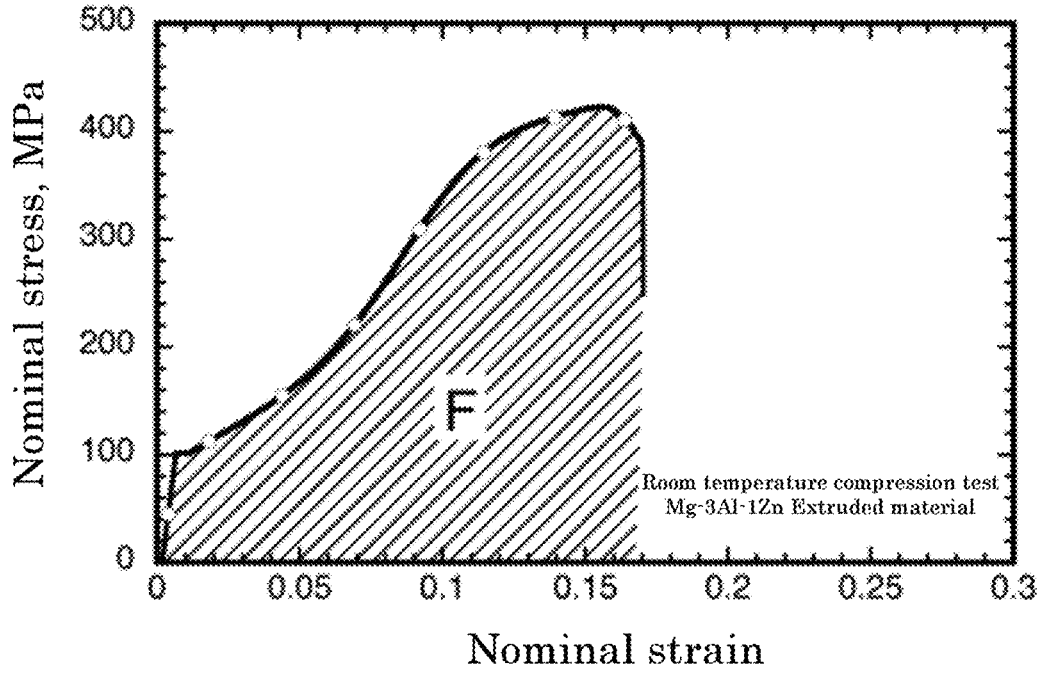
FIG. 2 shows a nominal stress-nominal strain curve obtained by a room temperature compression test of the Mg-3Al-1Zn alloy extruded material.

In FIGS. 1 and 2, the nominal stress-and-nominal strain curves obtained by the room temperature tensile test and compression test using a commercially available magnesium alloy (Mg-3 mass % Al-1 mass % Zn: commonly known as AZ31) are shown. In the stress-strain curve during the tensile test as shown in FIG. 1, a slight work-hardening occurs after yielding, and then, the specimen breaks when the nominal strain reaches about 0.2. On the other hand, in the stress-strain curve during the compression test as shown in FIG. 2, a large work-hardening occurs after yielding, and then, the specimen breaks around 0.2 of the nominal strain. In both tensile and compression tests, it should be understood that the specimens break at an early stage of deformation with respect to the conventional Mg-based alloy.

The degree of stress reduction may be obtained by the formula (1) and preferably is at least 0.2 and more preferably is at least 0.25.

[Formula 1]

$$\text{Degree of stress reduction} = \frac{\sigma_{max} - \sigma_{bk}}{\sigma_{max}} \quad \text{(Formula 1)}$$

Here, $\sigma_{max}$ is the maximum applied stress and $\sigma_{bk}$ is the stress at break and their examples are shown in FIG. 1.

Next, the resistance against the fracture: F corresponds to the area enclosed by the nominal stress-and-nominal strain curve obtained by the room temperature compression test as shown in FIG. 2 and the larger the area is, the larger the resistance against the fracture (=energy absorption capacity) is (cf. shaded area in the figure). This resistance: F is also obtained, as the area enclosed by the nominal stress-and-nominal strain curve, from the nominal stress-and-nominal strain curve obtained by the room temperature tensile test in the same way. The F tends to increase as the testing rate is speeded up since it is affected by the strain rate. Therefore, when the value of F may be obtained under the condition that the initial strain rate is $1\times10^{-3}$ $s^{-1}$, it is preferably 200 kJ or more, and more preferably 250 kJ or more, yet more preferably 300 kJ or more. Here, a similar nominal stress-and-nominal strain curve (FIG. 1) to that of the compression test can be obtained by the tensile test, but the resistance against the fracture may be evaluated more strictly by the compression test than by the tensile test since the specimen breaks with a slight nominal strain in the case of the Mg-based alloy.

Embodiments

A Mg—Mn mother alloy was manufactured with an iron crucible from a commercially available pure Mn (99.9 mass %) and a commercially available pure Mg (99.98 mass %). In a similar manner, a Mg—Zr mother alloy was manufactured using a commercially available pure Zr and a commercially available pure Mg. Using the respective mother alloys, a Mg—Mn—Zr alloy cast material was manufactured by adjusting the composition to the target constituent contents of 0.1 mol % Mn-0.1 mol % Zr and melting it in an iron crucible. Here, the cast material was made by melting the composition in an Ar atmosphere at a melting temperature of 700 degree Celsius for a melt holding time of 5 minutes and pouring the melt into an iron mold having a diameter of 50 mm and a height of 200 mm. Then, the cast material was heat-treated for the solution treatment at 500 degree Celsius for 8 hours.

The cast material after the solution treatment was machined into a cylindrical extrusion billet having a diameter of 40 mm and a length of 60 mm by the machine working. After the thus-machined billet was held in a container kept at 165 degree Celsius for 30 minutes, an extruded material in a shape having a diameter of 8 mm and a length of 500 mm or longer (hereinafter referred to as "extruded material") was manufactured by the extrusion with the extrusion ratio of 25:1 (=reduction rate: 94%) through the hot strain application process.

In the case where Mn and Zr were used as the additive, the above-mentioned respective mother alloys were used and, in the case where Bi and Sn were added, commercially available pure Bi and pure Sn were used, and the composition was adjusted to the target composition and was melted in an iron crucible such that respective kinds of cast materials were manufactured by casting respective melts. Then, respective kinds of extruded materials were made through the solution treatment with the same condition (temperature and time) as mentioned above, the machine working process to form the cylindrical extrusion billet in the same dimension, and the extrusion working process with the same extrusion rate and the same holding time as mentioned above. Here, the extrusion temperatures are summarized in Table 1.

Figure 5:
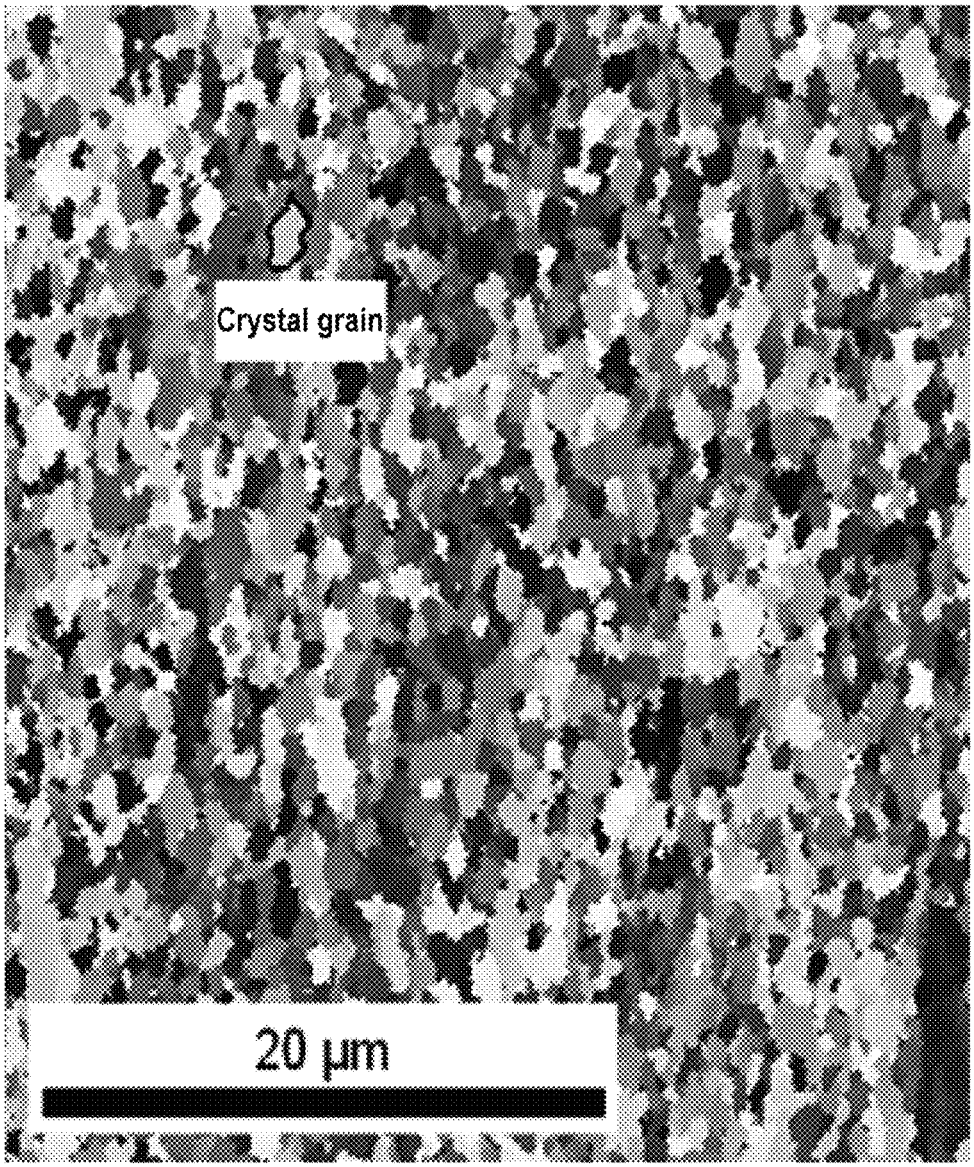
FIG. 5 shows a microstructure diagram obtained by the electron backscatter diffraction method of the Mg—Mn—Zr alloy extruded material of an embodiment.
Figure 6:
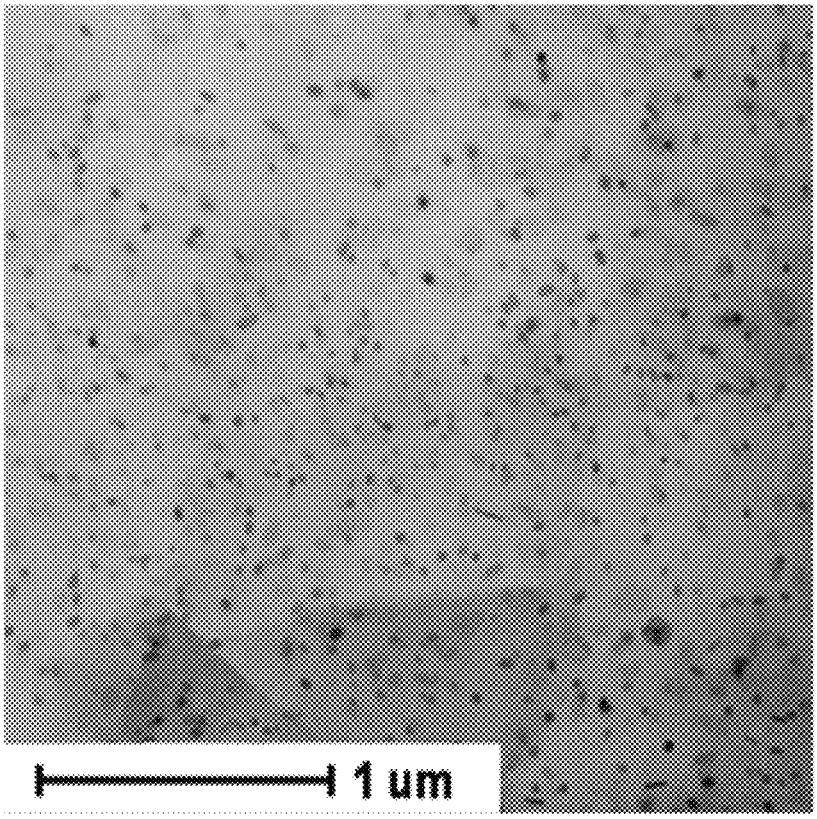
FIG. 6 shows a microstructure diagram obtained by the transmission electron microscope observation of the Mg-based alloy wrought material of an embodiment.

Fine structure appearances of the respective extruded materials were photographed with the optical microscope and average crystal grain sizes were obtained by the intersection method such that they are summarized in Table 1. In any of the extruded materials, the average crystal grain sizes were 5 micrometer or less. Here, the microstructural image obtained by the electron backscatter diffraction method is shown in FIG. 5. In the figure, a portion composed of the same contrast indicates one crystal grain, that is, the Mg parent phase and it can be confirmed that a size thereof is 5 micrometer or less. And the microstructural image obtained by the transmission electron microscope observation is shown in FIG. 6. An aggregate composed of black contrast indicates that of intermetallic compound. It can be confirmed that there are aggregates of intermetallic compound having diameters of 100 to 200 nm.

Figure 3:
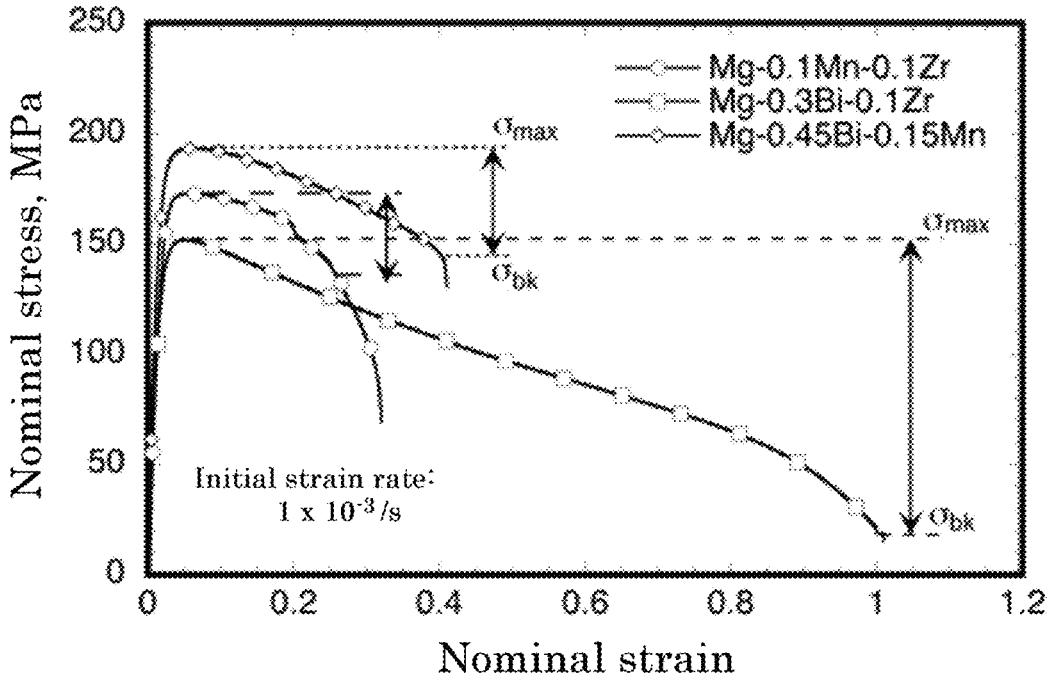
FIG. 3 shows a nominal stress-nominal strain curve obtained by a room temperature tensile test of a Mg-based alloy extruded material of an embodiment.

With respect to specimens cut out of the Mg-based alloy extruded material, a room temperature tensile test was conducted with the initial strain rate of $1\times10^{-3}$ $s^{-1}$. Round bar specimens a parallel portion length of 10 mm and having a parallel portion diameter of 2.5 mm were used with all tensile tests. The test pieces were cut out from the extruded material in the parallel direction to the extrusion direction. A nominal stress-nominal strain curve obtained by the room temperature tensile test with respect to Embodiment 2 is shown in FIG. 3. With respect to the Mg-0.3 Bi-0.1 Zr alloy extruded material, it can be confirmed that the tensile breaking strain was beyond 1.0 and an excellent ductility was exhibited. Here, when the nominal stress was suddenly dropped (20% during each measurement), it was defined as "breaking" such that the nominal strain at the time of breaking is referred to as the tensile breaking strain: eT, which is summarized in Table 1. It should be understood that every tensile breaking strain of the extruded materials exceeds 0.03 so as to exhibit an excellent tensile ductility.

TABLE 1

| No. | | | T, °C. | Heat treatment | d, um | F, kJ | eC | eT | Degree of stress reduction | Intermetallic compound grain diameter/μm |
|---|---|---|---|---|---|---|---|---|---|---|
| 1 | Extruded material | Mg-0.1Mn-0.1Zr | 165 | No | ≤5 | ≥350 | ≥0.5 | 0.42 | 0.24 | — |
| 2 | Extruded material | Mg-0.1Mn-0.1Zr | 165 | Yes | ≤8 | 336 | ≥0.5 | 0.40 | 0.22 | — |
| 3 | Extruded material | Mg-0.3Mn-0.1Zr | 130 | No | ≤5 | 504 | ≥0.5 | 1.04 | 0.56 | 0.4 |
| 4 | Extruded material | Mg-0.3Mn-0.1Zr | 130 | Yes | ≤8 | 475 | ≥0.5 | 0.50 | 0.50 | 0.4 |
| 5 | Groove-rolled material | Mg-0.3Bi-0.1Zr | 400 | No | ≤5 | 484 | ≥0.5 | 0.75 | 0.64 | 0.4 |
| 6 | Extruded material | Mg-0.6Mn-0.1Zr | 150 | No | ≤5 | 500 | ≥0.5 | 0.70 | 0.50 | 0.5 |
| 7 | Extruded material | Mg-0.3Bi-0.1Zr | 130 | No | ≤5 | ≥350 | ≥0.5 | 1.05 | 0.75 | — |
| 8 | Extruded material | Mg-0.3Bi-0.1Zr | 130 | Yes | ≤8 | 345 | ≥0.5 | 0.55 | 0.34 | — |
| 9 | Groove-rolled material | Mg-0.3Si-0.1Zr | 400 | No | ≤5 | 450 | ≥0.5 | 0.71 | 0.89 | — |
| 10 | Extruded material | Mg-0.6Bi-0.1Zr | 135 | No | ≤5 | 500 | ≥0.5 | 0.70 | 0.50 | 0.5 |
| 11 | Extruded material | Mg-0.45Bi-0.15Mn | 180 | No | ≤5 | ≥350 | ≥0.5 | 0.32 | 0.25 | 0.3 |
| 12 | Extruded material | Mg-0.6Bi-0.3Mn | 150 | No | ≤5 | 604 | ≥0.5 | 0.55 | 0.38 | 0.5 |
| 13 | Extruded material | Mg-0.6Bi-0.3Mn | 150 | Yes | ≤8 | 550 | ≥0.5 | 0.37 | 0.33 | 0.5 |
| 14 | Extruded material | Mg-0.9Bi-0.3Mn | 150 | No | ≤5 | 579 | ≥0.5 | 0.57 | 0.47 | 0.5 |
| 15 | Extruded material | Mg-0.9Bi-0.3Mn | 150 | Yes | ≤8 | 525 | ≥0.5 | 0.33 | 0.24 | 0.5 |
| 16 | Extruded material | Mg-0.3Bi-0.1Mn | 155 | No | ≤5 | 549 | ≥0.5 | 0.78 | 0.51 | — |
| 17 | Extruded material | Mg-0.3Bi-0.1Mn | 155 | Yes | ≤8 | 523 | ≥0.5 | 0.22 | 0.22 | — |
| 18 | Extruded material | Mg-0.9Mn-0.1Bi | 210 | No | ≤5 | 565 | 0.46 | 0.38 | 0.23 | 0.5 |

TABLE 1-continued

| No. | | | T, °C. | Heat treatment | d, um | F, kJ | eC | eT | Degree of stress reduction | Intermetallic compound grain diameter/μm |
|---|---|---|---|---|---|---|---|---|---|---|
| 19 | Extruded material | Mg-0.9Mn-0.1Bi | 210 | Yes | ≤8 | 515 | 0.40 | 0.23 | 0.21 | 0.5 |
| 20 | Extruded material | Mg-0.3Mn-0.1Bi | 150 | No | ≤5 | 588 | ≥0.5 | 0.77 | 0.50 | — |
| 21 | Extruded material | Mg-0.6Mn-0.1Bi | 210 | No | ≤5 | 320 | 0.25 | 0.30 | 0.25 | 0.3 |
| 22 | Groove-rolled material | Mg-0.3Mn-0.1Bi | 400 | No | ≤5 | 562 | ≥0.5 | 0.65 | 0.62 | — |
| 23 | Extruded material | Mg-0.9Mn-0.1Sn | 220 | No | ≤5 | 298 | 0.22 | 0.27 | 0.24 | 0.5 |
| 24 | Groove-rolled material | Mg-0.3Mn-0.1Sn | 300 | No | ≤5 | 380 | 0.25 | 0.48 | 0.39 | — |
| 25 | Extruded material | Mg-0.6Mn-0.1Sn | 150 | No | ≤5 | 839 | ≥0.5 | 0.41 | 0.35 | 0.3 |
| 26 | Extruded material | Mg-0.6Mn-0.1Sn | 150 | Yes | ≤8 | 674 | 0.45 | 0.33 | 0.22 | 0.3 |
| 27 | Extruded material | Mg-0.3Mn-0.1Sn | 170 | No | ≤5 | 437 | 0.32 | 0.51 | 0.31 | — |
| 28 | Extruded material | Mg-0.3Si-0.1Sn | 170 | No | ≤5 | 316 | 0.26 | 0.22 | 0.23 | — |
| 29 | Comparative material | AZ31 | 210 | No | ≤3 | 255 | 0.16 | 0.22 | 0.05 | — |
| 30 | Comparative material | AZ31 | — | No | 20 | 196 | 0.17 | 0.23 | 0.10 | — |

T: Extruding temperature
d: Average crystal grain size
F: Absorbed energy for break
eC: Compressive breaking strain
eT: Tensile breaking strain
Heat treatment: 200 degree Celsius to one hour In the nominal stress-and-nominal strain curve of the Mg-based alloy extruded material in the tensile test as shown in FIG. 3, it should be understood that a large stress reduction is shown after the maximum applied stress is reached. For example, in the case of the Mg-0.3 Bi-0.1 Zr alloy extruded material, the value of $(\sigma_{max}-\sigma_{bk})/\sigma_{max}$ shows 0.75 such that it is suggested that the plastic deformation limit is large and the formability is excellent. From Table 1, it should be understood that every value of $(\alpha_{max}-\sigma_{bk})/\sigma_{max}$ of the extruded materials is larger than that of the commercially available magnesium alloy: AZ31 such that an excellent formability is shown.

Figure 4:
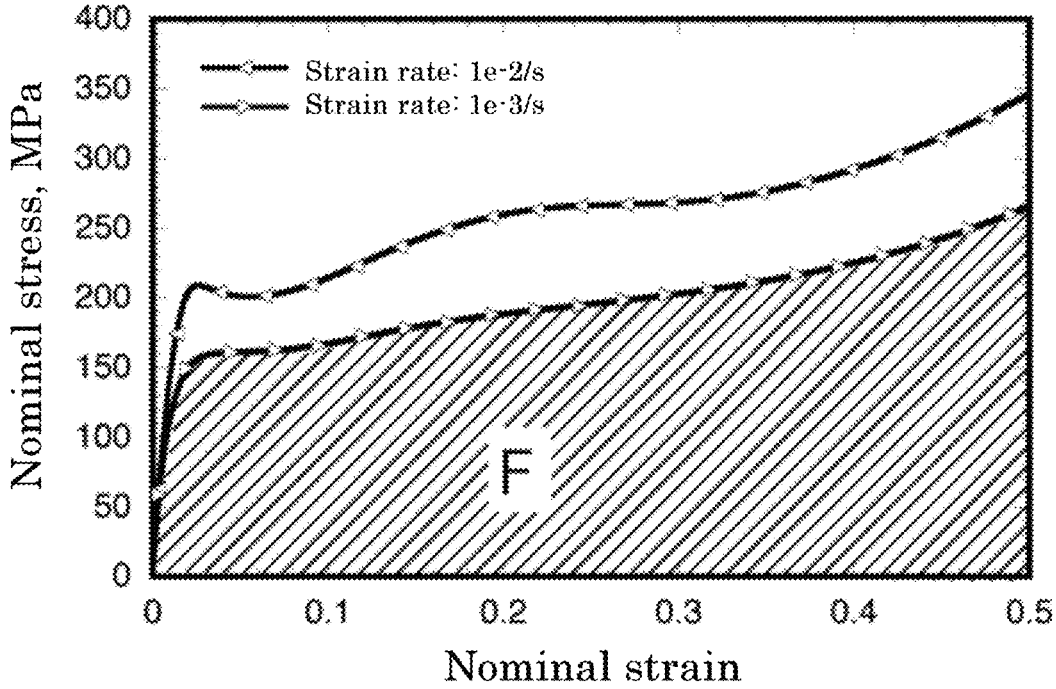
FIG. 4 shows a nominal stress-nominal strain curve obtained by a room temperature compression test of a Mg—Mn—Zr alloy extruded material of an embodiment.

With respect to test pieces cut out from the Mg-based alloy extruded material, room temperature compression tests were conducted with the initial strain rates of $1\times10^{-2}$ and $1\times10^{-3}$ $s^{-1}$. As the specimen, a cylindrical test piece having a height of 8 mm and a diameter of 4 mm was used. The test piece was taken in the parallel direction to the extrusion direction. In FIG. 4, a nominal stress-nominal strain curve with Embodiment 2 obtained by the room temperature compression test is shown. It should be understood that, even after the nominal strain in the compression test reaches 0.5, stress reduction as shown in FIG. 2 does not appear, but the deformation continues. And the shaded area in the figure corresponds to the resistance against the fracture, which is determined to be 403 kJ. It should be understood that the area enclosed by the stress-and-strain is increased when the initial strain rate of the compression test is higher by one order of magnitude. In Table 1, values of F are summarized with the initial strain rate: $1\times10^{-3}$ $s^{-1}$. It can be confirmed that every extruded material exhibits an excellent resistance against the fracture. And when the nominal stress in the compression test was suddenly dropped (20% during each measurement), it was defined as "breaking" such that the nominal strain at the time of breaking is referred to as the compressive breaking strain: eC, which are summarized in Table 1. Here, it is suggested that, even if the compression nominal strain of 0.50 is applied, no breaking occurs such that it has an excellent compression deformability.

Here, concrete procedures of the groove rolling process are described as follows. Each kind of cast material after the solution treatment was machined into a cylindrical extrusion billet having a diameter of 40 mm and a length of 80 mm through the mechanical working. The thus-machined billet was held in an electric furnace kept at 400 degree Celsius for 30 minutes or longer. hen, rolling was repeatedly performed in the condition that the rolling temperature was set to the room temperature and that the cross-section reduction rate for one rolling was set to 18% such that the total cross-section reduction rate might be 92%. (Hereinafter, it is referred to as "groove-rolled material".)

Each room temperature property of the groove-rolled materials is summarized in Table 1. It can be confirmed that excellent values are shown as compared to those of the commercially available magnesium alloy: AZ31 even if the groove-rolling method was employed as the expansion forming process method. Here, the tensile and compression test pieces were taken in the parallel direction to the rolling direction and the test condition was the same as that of the above-mentioned extruded material.

Further, the effect of the crystal grain size on the resistance against the fracture and the degree of stress reduction was investigated. Each kind of the Mg-based alloy extruded materials was held in a muffle furnace kept at 200 degree Celsius for one hour. Then, the room temperature tensile and compression tests were performed with test pieces of the same size and shape in the same procedures as mentioned above. The obtained results are summarized in Table 1. It can be confirmed that excellent values are shown as compared to those of the commercially available magnesium alloy: AZ31 even if the average crystal grain sizes were coarsened.

Comparative Embodiment

The room tensile and compression tests were performed with the extruded material of the commercially available magnesium alloy (Mg-3 mass % Al-1 mass % Zn: commonly known as AZ31). The same test piece size and shape and the same test condition were employed as those of the above-mentioned embodiments. The breaking elongations, degrees of stress reduction, values of F, and so on obtained by the tensile and compression tests are summarized in Table 1. And a microstructural image obtained with the optical microscope is shown in FIG. 7. The crystal grain boundaries are indicated by line in a black color and the area enclosed by a black line corresponds to one crystal grain.

Here, in embodiments of the present invention, the refinement of the internal structure was attempted by the one-time plastic-strain application method, but the plastic-strain application can be performed for a plurality of times in the case where the cross-section reduction rate is smaller than a predetermined value.

INDUSTRIAL APPLICABILITY

The Mg-based alloy of the present invention exhibits an excellent room temperature ductility so as to have a good secondary workability and be easily formed into a complicated shape such as a plate shape. In particular, it has an excellent property for the stretch forming, the deep drawing, and so on. And, since the grain boundary sliding is caused, it has an excellent internal friction property so as to be applied possibly to the part in which vibration and noise are to be a technical problem. Further, since a small amount of versatile element is added such that the rare earth element is not used, it is possible to reduce the price of the raw material as compared to the conventional rare earth added Mg alloy.

EXPLANATION OF REFERENCE NUMERALS $\sigma_{max}$ maximum applied stress;
$\sigma_{bk}$ stress at beak:
F resistance against fracture (=energy absorption capacity)

What is claimed is:

1. A Mg-based alloy wrought material comprising: Mg-A mol % Bi—B mol % Sn wherein a remainder comprises Mg and unavoidable impurities, wherein a value of A is at least 0.3 mol % and not exceeding 0.5 mol %, wherein, with respect to a relationship of A and B, A≥B and an upper limit of B is not exceeding 0.8 times as large as an upper limit of A and a lower limit of B is at least 0.1 mol %, and wherein an average crystal grain size of the Mg-based alloy wrought material is not exceeding 10 micrometers.

2. The Mg-based alloy wrought material according to claim 1, wherein intermetallic compound particles constituted of Mg and Bi; Mg and Sn; or Mg, Bi, and Sn and having an average diameter of not exceeding 0.5 micrometers exist in a Mg mother phase and/or crystal grain boundaries of a metallographic structure of the Mg-based alloy wrought material.

3. The Mg-based alloy wrought material according to claim 1, wherein a value of a formula of $(\sigma_{max}-\sigma_{bk})/\sigma_{max}$ is at least 0.2 when a maximum applied stress is defined as $\sigma_{max}$ and a stress at break is defined as $\sigma_{bk}$ in a stress-strain diagram obtained by a room temperature tensile test with an initial strain rate not exceeding $1\times10^{-3}$ $s^{-1}$.

4. The Mg-based alloy wrought material according to claim 1, wherein the Mg-based alloy wrought material does not break even if a nominal strain of at least 0.2 is applied in a room temperature tensile test or compression test with an initial strain rate not exceeding $1\times10^{-3}$ $s^{-1}$.

5. The Mg-based alloy wrought material according to claim 1, wherein an area enclosed by a nominal stress-and-nominal strain curve in a stress-strain diagram obtained by a room temperature compression test with an initial strain rate of at least $1\times10^{-3}$ $s^{-1}$ exhibits at least 200 kJ with respect to the Mg-based alloy wrought material.

6. A method of manufacturing a Mg-based alloy wrought material as described in claim 1, the method comprising:

performing a solution treatment of a Mg-based alloy cast material having been melted and cast at a temperature of at least 400 degrees Celsius and not exceeding 650 degrees Celsius for at least 0.5 hours and not exceeding 48 hours and, performing a hot plastic working for the Mg-based alloy cast material having been treated by the solution treatment at a temperature of at least 50 degrees Celsius and not exceeding 550 degrees Celsius with at least 80% of cross-section reduction rate as a process of applying plastic strain.

7. The method of manufacturing the Mg-based alloy wrought material according to claim 6, wherein the process of applying plastic strain comprises any one of extrusion, forging, rolling, and drawing.

8. The Mg-based alloy wrought material according to claim 2, wherein a value of a formula of $(\sigma_{max}-\sigma_{bk})/\sigma_{max}$ is at least 0.2 when a maximum applied stress is defined as $\sigma_{max}$ and a stress at break is defined as $\sigma_{bk}$ in a stress-strain diagram obtained by a room temperature tensile test with an initial strain rate not exceeding $1\times10^{-3}$ $s^{-1}$.

9. The Mg-based alloy wrought material according to claim 2, wherein the Mg-based alloy wrought material does not break even if a nominal strain of at least 0.2 is applied in a room temperature tensile test or compression test with an initial strain rate not exceeding $1\times10^{-3}$ $s^{-1}$.

10. The Mg-based alloy wrought material according to claim 3, wherein the Mg-based alloy wrought material does not break even if a nominal strain of at least 0.2 is applied in a room temperature tensile test or compression test with an initial strain rate not exceeding $1\times10^{-3}$ $s^{-1}$.

11. The Mg-based alloy wrought material according to claim 8, wherein the Mg-based alloy wrought material does not break even if a nominal strain of at least 0.2 is applied in a room temperature tensile test or compression test with an initial strain rate not exceeding $1\times10^{-3}$ $s^{-1}$.

12. The Mg-based alloy wrought material according to claim 2, wherein an area enclosed by a nominal stress-and-nominal strain curve in a stress-strain diagram obtained by a room temperature compression test with an initial strain rate of at least $1\times10^{-3}$ $s^{-1}$ exhibits at least 200 kJ with respect to the Mg-based alloy wrought material.

13. The Mg-based alloy wrought material according to claim 3, wherein an area enclosed by a nominal stress-and-nominal strain curve in a stress-strain diagram obtained by a room temperature compression test with an initial strain rate of at least $1\times10^{-3}$ $s^{-1}$ exhibits at least 200 kJ with respect to the Mg-based alloy wrought material.

14. The Mg-based alloy wrought material according to claim 4, wherein an area enclosed by a nominal stress-and-nominal strain curve in a stress-strain diagram obtained by a room temperature compression test with an initial strain rate of at least $1\times10^{-3}$ $s^{-1}$ exhibits at least 200 kJ with respect to the Mg-based alloy wrought material.

15. The Mg-based alloy wrought material according to claim 8, wherein an area enclosed by a nominal stress-and-nominal strain curve in a stress-strain diagram obtained by a room temperature compression test with an initial strain rate of at least $1\times10^{-3}$ $s^{-1}$ exhibits at least 200 kJ with respect to the Mg-based alloy wrought material.

16. The Mg-based alloy wrought material according to claim 9, wherein an area enclosed by a nominal stress-and-nominal strain curve in a stress-strain diagram obtained by a room temperature compression test with an initial strain rate of at least $1\times10^{-3}$ $s^{-1}$ exhibits at least 200 kJ with respect to the Mg-based alloy wrought material.

17. The Mg-based alloy wrought material according to claim 10, wherein an area enclosed by a nominal stress-and-nominal strain curve in a stress-strain diagram obtained by a room temperature compression test with an initial strain rate of at least $1\times10^{-3}$ $s^{-1}$ exhibits at least 200 kJ with respect to the Mg-based alloy wrought material.

18. The Mg-based alloy wrought material according to claim 11, wherein an area enclosed by a nominal stress-and-nominal strain curve in a stress-strain diagram obtained by a room temperature compression test with an initial strain rate of at least $1\times10^{-3}$ $s^{-1}$ exhibits at least 200 kJ with respect to the Mg-based alloy wrought material.

19. A method of manufacturing a Mg-based alloy wrought material as described in claim 2, the method comprising:

performing a solution treatment of a Mg-based alloy cast material having been melted and cast at a temperature of at least 400 degrees Celsius and not exceeding 650 degrees Celsius for at least 0.5 hours and not exceeding 48 hours and, performing a hot plastic working for the Mg-based alloy cast material having been treated by the solution treatment at a temperature of at least 50 degrees Celsius and not exceeding 550 degrees Celsius with at least 80% of cross-section reduction rate as a process of applying plastic strain.

20. The method of manufacturing the Mg-based alloy wrought material according to claim 19, wherein the process of applying plastic strain comprises any one of extrusion, forging, rolling, and drawing.

* * * * *